US009145249B2

(12) United States Patent
Adams

(10) Patent No.: US 9,145,249 B2
(45) Date of Patent: Sep. 29, 2015

(54) BULK LIQUID/MATERIAL CONSTRUCTION BLOCK UTILITY KIT

(71) Applicant: Wendell B. Adams, Winter Garden, FL (US)

(72) Inventor: Wendell B. Adams, Winter Garden, FL (US)

( * ) Notice: Subject to any disclaimer, the term of this patent is extended or adjusted under 35 U.S.C. 154(b) by 291 days.

(21) Appl. No.: 13/915,218

(22) Filed: Jun. 11, 2013

(65) Prior Publication Data

US 2014/0360897 A1 Dec. 11, 2014

(51) Int. Cl.

| | |
|---|---|
| ***B65D 79/00*** | (2006.01) |
| ***B65D 81/36*** | (2006.01) |
| ***E04B 1/12*** | (2006.01) |
| ***E04H 9/06*** | (2006.01) |
| ***E04H 9/10*** | (2006.01) |

(52) U.S. Cl.

CPC ..... *B65D 79/00* (2013.01); *B65D 81/361* (2013.01); *E04B 1/12* (2013.01); *E04H 9/06* (2013.01); *E04H 9/10* (2013.01)

(58) Field of Classification Search

CPC ..... B65D 81/361; B65D 5/001; B65D 79/00; E04B 2/02; E04B 1/12; E04H 9/06; E04H 9/10; E02D 9/015; A47J 33/00

USPC ..... 52/604, 603, 606, 561, 563, 565, 284, 52/562, 564, 568, 605, 607; 206/504, 509

See application file for complete search history.

(56) References Cited

U.S. PATENT DOCUMENTS

| | | | | |
|---|---|---|---|---|
| 1,809,596 | A | | 6/1931 | Nason |
| 3,194,426 | A | | 7/1965 | Brown, Jr. |
| 3,391,824 | A | | 7/1968 | Wiseman |
| 3,474,843 | A | | 10/1969 | Maris |
| 3,548,803 | A | * | 12/1970 | Vogel ..... 126/25 R |
| 3,994,408 | A | | 11/1976 | Belitzky |
| 4,075,078 | A | | 2/1978 | Nickell |
| 4,110,949 | A | | 9/1978 | Cambiuzzi et al. |
| 4,624,383 | A | | 11/1986 | Moore |
| 5,056,424 | A | | 10/1991 | Lai |
| 5,493,816 | A | | 2/1996 | Willemsen |
| 5,582,801 | A | | 12/1996 | DeWitt et al. |
| 5,740,637 | A | | 4/1998 | Snow |
| 5,832,687 | A | | 11/1998 | Willemsen |
| 6,088,987 | A | | 7/2000 | Simmons et al. |
| 6,161,357 | A | | 12/2000 | Altemus |
| 6,233,897 | B1 | | 5/2001 | Jurik |
| 6,276,549 | B1 | | 8/2001 | Fasci et al. |
| 6,571,525 | B2 | | 6/2003 | Coleman |
| 6,585,090 | B2 | | 7/2003 | Harvey |
| 6,663,323 | B1 | | 12/2003 | Boys |
| 6,889,479 | B2 | | 5/2005 | Thorpe |

(Continued)

*Primary Examiner* — Ryan Kwiecinski

*Assistant Examiner* — Alp Akbasli

(74) *Attorney, Agent, or Firm* — McHale & Slavin, P.A.

(57) ABSTRACT

A utility kit for use in combination with a plastic construction block used for storage of water, food, medicine, staples, construction materials, or any other item that needs to be contained for storage and shipping. The utility kit includes a fire grate and utility receptacles to allow for cooking of water and food. Upon emptying of the construction block, the construction block can be used in the construction of a bunker, wall, or the like structure through conventional building construction by filling of the block with sand or dirt. The utility receptacles can be used to reinforce the construction block as well as provide sealing for half blocks. The fire grate can be dismantled and the anchoring pipes can operate to anchor construction blocks together during construction.

8 Claims, 9 Drawing Sheets

(56) References Cited

U.S. PATENT DOCUMENTS

| | | | | |
|---|---|---|---|---|
| 6,948,282 | B2 * | 9/2005 | Bott | 52/98 |
| 7,140,493 | B2 | 11/2006 | Fry | |
| 7,546,712 | B2 * | 6/2009 | Shaw | 52/223.8 |
| 7,699,171 | B2 | 4/2010 | Rivera et al. | |
| 7,712,281 | B2 | 5/2010 | Bott | |
| 8,316,610 | B2 | 11/2012 | Adams | |
| 2003/0074856 | A1 | 4/2003 | Hammer | |
| 2005/0023174 | A1 | 2/2005 | Lary et al. | |
| 2005/0178081 | A1 | 8/2005 | Bott | |
| 2005/0257481 | A1 | 11/2005 | Shaw | |
| 2006/0254947 | A1 | 11/2006 | Rogers | |
| 2007/0154265 | A1 | 7/2007 | Stauffacher et al. | |
| 2008/0184649 | A1 * | 8/2008 | Khan | 52/592.6 |
| 2008/0298902 | A1 | 12/2008 | Knudson et al. | |
| 2009/0077920 | A1 | 3/2009 | Korman et al. | |
| 2009/0126280 | A1 | 5/2009 | Radi et al. | |
| 2009/0217610 | A1 | 9/2009 | Curtis | |
| 2011/0197872 | A1 * | 8/2011 | Thiry | 126/25 R |
| 2013/0032138 | A1 * | 2/2013 | Kihlstroem | 126/9 R |
| 2013/0125766 | A1 * | 5/2013 | George | 99/425 |

* cited by examiner

BULK LIQUID/MATERIAL CONSTRUCTION BLOCK UTILITY KIT

RELATED REFERENCE

This application is related to U.S. Pat. No. 8,316,610, entitled "BULK LIQUID AND MATERIAL DELIVERY DEVICE AND CONSTRUCTION BLOCK", issued Nov. 27, 2012, the contents of which are incorporated herein by reference.

FIELD OF THE INVENTION

This invention is related to portable containers and more particularly to a utility kit for use with a construction block formed from a portable container that can used in storage and shipping of various supplies.

BACKGROUND OF THE INVENTION

Humans need water, food, and shelter to survive. These essential items can be difficult due to natural or man-made disasters, or war. For instance, a drought can result in the loss of potable water, a war can result in a lack of medicine, a hurricane can result in the loss of shelter, and so forth. While providing relief supplies to such areas is critical, it is important that all aspects of the relief supplies can be used.

In many instances, potable water is provided in containers and the containers are discarded after use. Similarly, food may be provided in containers wherein the containers are discarded after use. The Applicant recognized the problems with shipping and wasted packaging. The Applicant further recognized that conventional construction materials are very expensive to ship. There are numerous reasons why a conventional structure could not be built immediately after a disaster including the lack of skilled labor. However, there is always an immediate need for shelter and waiting for construction materials and skilled labor can be impractical. For instance, after the earthquake disaster in Haiti, families were in dire need of food, water, and shelter. Transports made herculean efforts to deliver food and water, and the delivery of construction materials would naturally follow.

The Applicant was granted U.S. Pat. No. 8,316,610 for a multipurpose container having a hollow interior with a fill port opening receptive to storing of water, food, or other supplies. The container can be immediately assembled to create a temporary structure, the structure can then be dismantled as the food, water and supplies are needed. Once water, food, or other supplies are withdrawn from the containers, hereinafter referred to as construction blocks, the construction blocks can then be reused to hold earth materials to allow for structure formation. The construction blocks have interlocking protrusions and receptacles for use in aligning similar shaped construction blocks for building of a structure, the construction block further included an anchoring pipe that was attached to the external surface of the block which would be used to interconnect construction blocks.

What the applicant has discovered to be lacking in the art is for a utility kit for use in combination with construction blocks wherein the kit provides utility receptacles and a fire grate that can be used in preparing the contents of the construction block for human consumption, the utility receptacles further operate as shovels for filling of the construction blocks with earth sand or soil, and the grate can be dismantled to provide further anchoring structure.

Known prior art includes U.S. Pat. No. 5,056,424 which discloses a skillet, a cooking pan, and a kettle where the cooking pan nests within the skillet and the kettle nests within the skillet over the cooking pan. The cooking pan, inverted, fits over the skillet to form a food storage container, and the skillet handle, when the assembly is assembled, fits over and around the kettle, locking the cooking assembly together.

U.S. Pat. No. 4,075,078 discloses a survival kit, used for containing items for use in a survival emergency, which can be emptied of its contents and its parts can be assembled in varying combinations to become alternately a canteen flask, stew pot, kettle, or skillet.

U.S. Pat. No. 1,809,596 discloses a canteen and a pair of pans adapted to cap opposite sides of the canteen in a nesting engagement. The nesting engagement can be received by a kettle formed to hold the pans in place on the canteen.

Thus what is needed in the art is an apparatus that can provide necessary cooking materials and be utilized as a construction block for use in the building of bunkers, retention walls, small homes, and the like, structures for the protection of humans and their property.

SUMMARY OF THE INVENTION

Disclosed is a utility kit for use in combination with a construction block. The Applicant's construction block is formed from HDPE plastic that may be used for storage of water, food, medicine, staples, construction materials, or any other item that needs to be contained for storage and shipping. The interior of the construction block is hollow and sized to hold about 3.4 gallons of fluid. The utility kit includes a first and second utility receptacle that can be placed over each end of the construction block during storage. In addition, a grate is held along the side of the construction block by use of the utility receptacles. The utility receptacles capture the ends of the grate holding thereby holding the grate in a storage position allowing for ease of transport.

When needed, the utility receptacles are removed from each end of the construction block thereby releasing the grate. The grate can then be placed over a fire providing a surface for supporting the utility receptacle for cooking purposes. Since the construction block can hold most any material, the utility receptacles have almost unlimited use. For instance, if the construction block is used to ship water, the utility receptacle can be used as a drinking cup or it can be used in combination with the grate to boil the water. If the construction block contains food, such as rice, the utility receptacle could be used for cooking the rice before eating. A second utility receptacle may be used in a similar manner or it can be used for eating purposes if the first utility receptacle is used only for cooking purposes. In addition, the utility kit can include eating utensils which can be placed within the container. Further, flatware can be placed between the utility receptacle and the construction block.

Upon removal of the stored items, the construction block can also be used as a building block in the construction of a bunker, wall, or the like building construction by filling of the block with sand or dirt. The construction block is substantially rectangular in shape having an enlarged fill port on one end and a resealable cap. Apertures extend through the block and are used for receipt of anchoring posts. Each aperture further having a raised protrusion formed integral along one surface and a receptacle placed abut each aperture on the rear surface. The raised protrusion interlocking with a receptacle on a rear surface of an adjoining construction block for aligning similar shaped construction blocks. An anchoring pipe can be provided independently or formed from the support rods used by the fire grate. The support rods of the fire grate are positioned in retaining sockets that have a depth allowing nearly a flush retention of the grate to the construction block for use in storage and shipping.

An objective of the invention is to provide a utility kit for use in combination with a hollow construction block that can be used for preparing the contents of items stored in the construction block.

Another objective of the instant invention is to provide multifunction utility receptacles for use as drinking cups, bowls, pans, pots, shovels, or construction block reinforcement.

Still another objective of the instant invention is to provide a fire grate for utility use for supporting of the utility receptacles over a fire.

Yet still another objective of the instant invention is to provide a fire grate constructed from rods that can be detached for use as posts for anchoring of the construction blocks.

Still another objective of the instant invention is to provide a container that holds two utility receptacles and a fire grate.

Yet another objective of the instant invention is to provide affordable, sustainable housing by use of the construction block that can operate as a shipping container.

Another objective of the instant invention is to provide a construction block having reinforced ends that can withstand harsh treatment.

Yet another objective of the instant invention is to provide a utility kit in combination with a construction block capable of bulk water storage for hurricane or storm preparedness, camping, or boating, having a secondary use as cooking preparation materials.

Still another objective of the instant invention is to provide a utility kit that operates as a mess kit, wherein the kit includes eating utensils that are placed within a construction block used for transporting food, and flatware plates are stored placed between the utility receptacle and the construction block.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE PREFERRED EMBODIMENT

Figure 1:
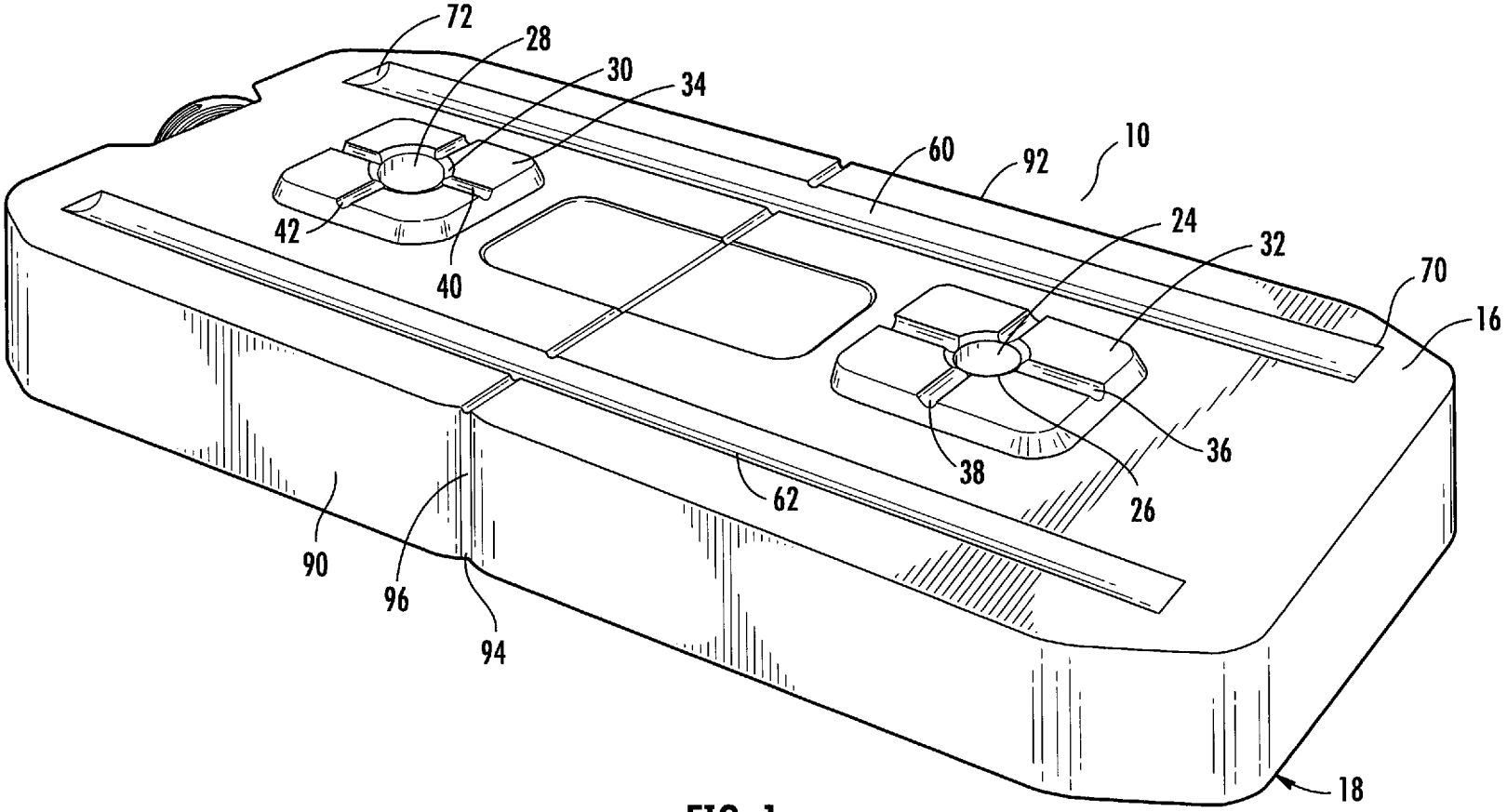
FIG. 1 is a perspective view of the construction block.
Figure 2:
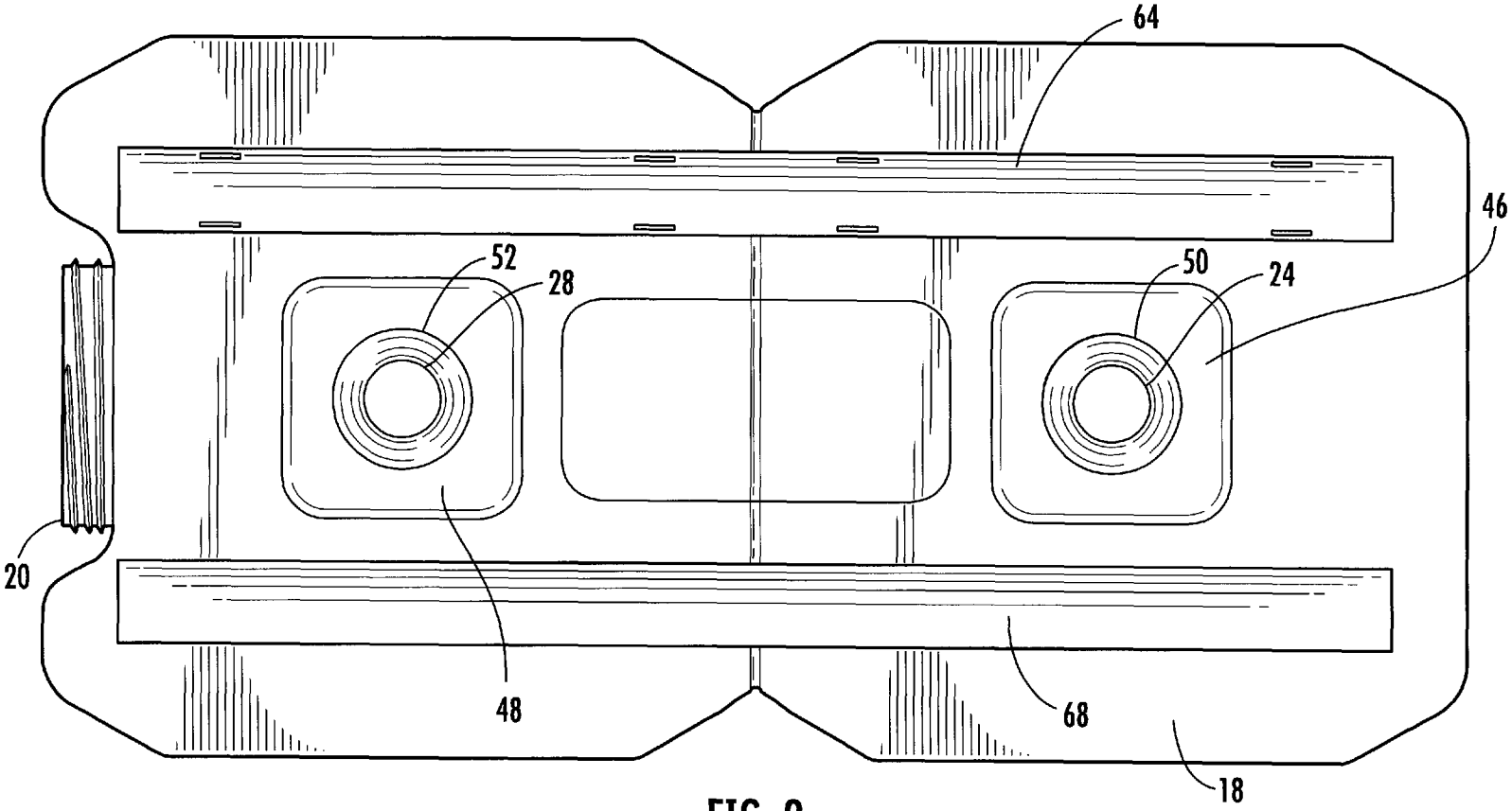
FIG. 2 is a bottom view of a construction block.
Figure 3:
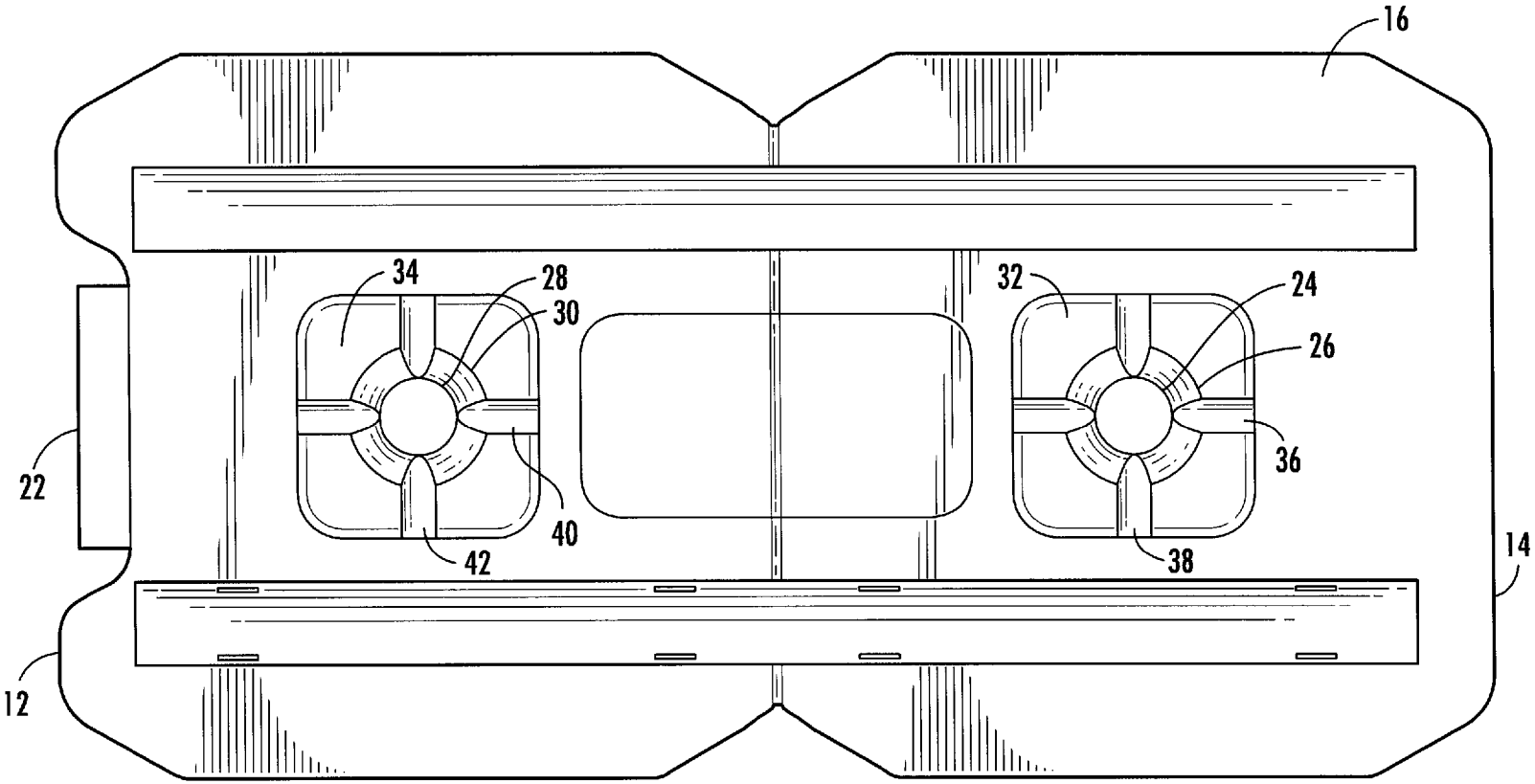
FIG. 3 is a top view of the construction block.

Now referring to the figures, set forth is the construction block (10) of the instant invention formed from a structure having a top surface (12), a bottom surface (14), a front surface (16) a rear surface (18), and opposing side walls (90 and 92). The top surface (12) includes a fill port (20) which is threaded and enclosed upon receipt of a threaded cap (22). The inside of the construction block is hollow, having a volume that will hold approximately 3.4 gallons of water. The preferred structure and cap material is a food grade quality, high density polyethylene (HDPE) plastic.

The construction block has a first aperture (24) which extends from the front surface (16) to the rear surface (18). The aperture (24) includes a funnel shaped enlarged opening (26) along the front surface (16) which is reduced down to a sized opening approximately halfway between the front surface (16) and the rear surface (18) so as to allow self aligning of a pipe or similar anchoring mechanism when adjoining construction blocks are placed together. For example, when similar construction blocks are stacked, the aperture is used for placement of an anchoring pipe (80) between adjoining construction blocks or for extension into a foundation as a foundation anchor. So as to ease in the assembly, the construction block employs the funnel shaped opening as an alignment mechanism to provide ease of anchor stick or pipe insertion through a stack of construction blocks. A second aperture (28) is located along the other end of the construction block to provide a similarly shaped funnel opening (30) leading to a sized opening approximately halfway between the front surface and the rear surface. The preferred sized opening is to accommodate a three quarters of an inch diameter pipe or the like alignment mechanism.

The front surface (16) of the construction block further includes raised protrusions (32 and 34) which are formed integral with the structure and placed about the first and second aperture. In the preferred embodiment, there are two square shaped protrusions, but the use of three, four, five, or six protrusions, or various other shapes may be used. The raised protrusion (32) includes grooves (36 and 38) which allows material displacement during installation as well as structural rigidity to the protrusions. Similarly, protrusion (34) includes grooves (40 and 42) again for ease of material displacement and rigidity. Protrusion (32) operates in conjunction with a receptacle (46) found on the rear surface (18) of an adjoining construction block (100) as does protrusion (34) operate with a receptacle (48) located on the rear surface (18) of an adjoining construction block (100). The protrusions are constructed and arranged to interface with a receptacle on an adjoining construction block (100), with receptacles being in the same format as the aforementioned receptacles (46 and 48). Receptacle (46) is shown illustrated with pass through aperture (24) and it further includes a funnel shaped opening (50). Similarly, receptacle (48) provides access to sized opening aperture (28) with a funnel shaped opening (52).

Each construction block (10) includes at least two anchoring pipe retaining sockets (60 and 62). The pipe retaining sockets have a depth approximately equal to the diameter of a rod post (146 and 148) and are used for maintaining the rod posts during storage and shipping. In one embodiment, the construction block (10) has a first anchoring pipe retaining socket (60) and a second anchoring pipe retaining socket (62) allowing placement of two PVC pipes or cross shaped stakes (80) that are frictionally engaged into the retaining sockets to prevent dislodgement during shipping. It should be noted that the rear surface (18) has reciprocal retaining sockets (64 and 68) that allow an adjoining construction block (100) to be aligned with the protrusion and receptacle arrangement but further provide a possible interlocking arrangement when the construction blocks are stacked for shipping. For instance, when two adjoining construction blocks are pressed together, the anchoring pipes (80) are frictionally attached to each construction block thereby maintaining the construction block in a secure manner. Frictional fit can include a sufficient interference fit so as to require the construction blocks to be pried apart when an anchoring pipe is placed in the top anchoring pipe retaining socket (60) engaging a bottom anchoring pipe retaining socket (68). Alternatively, each end (70 and 72) can be sized to cause interference fit with the ends of an anchoring pipe (80) to maintain the anchoring pipe (80) in the anchoring pipe retaining socket (60) yet not frictionally engage the side walls of the anchoring pipe retaining socket (60). In the alternative embodiment, an adjoining construction block (100) may be placed in a stacked manner and the anchoring pipes (80) would not frictionally engage each construction block (10), however an anchoring pipe (80) placed in there would allow alignment of each construction block and would permit ease of removal without the need of prying apart adjoining construction blocks. In the preferred embodiment with the Utility Kit, the anchoring pipe retaining sockets (60 and 62) house the rod posts (146 and 148) of the fire grate (140) during shipping, and the fire grate (140) is maintained in place by the utility receptacles (142) and 144).

Figure 4:
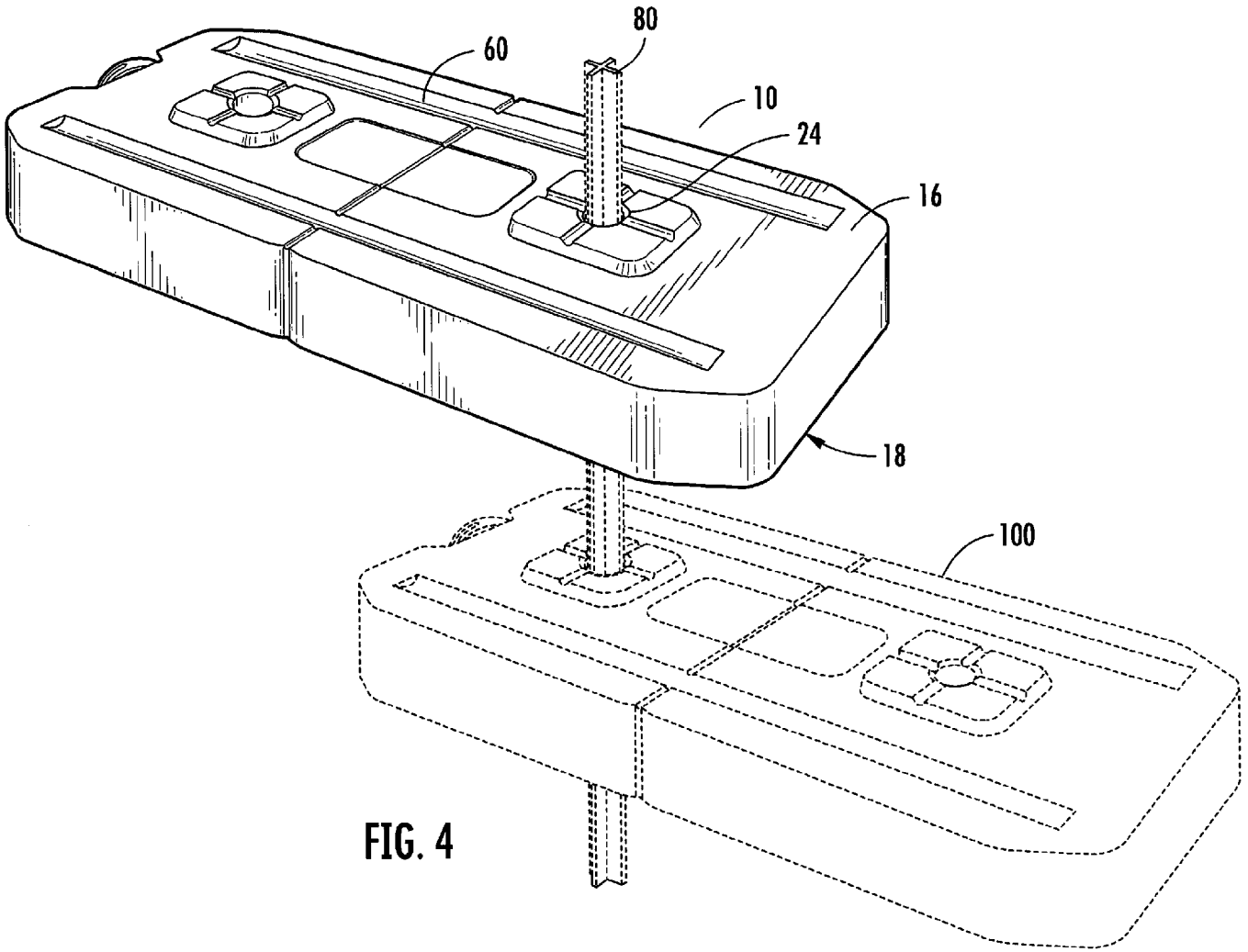
FIG. 4 is a perspective view of a construction block in conjunction with an adjoining construction block with an anchoring pipe being placed therebetween.

As shown in FIG. 4, the construction block (10) is illustrated in an exploded view being stacked with construction block (100) wherein a stake (80) which has been removed from groove (60) is placed through aperture (24) extending from the front surface (16) to the rear surface (18) for alignment to an adjoining construction block having a similar aperture. The illustration shows the blocks in an offset arrangement for stacking in a conventional brick and mortar block construction technique.

The construction block further includes an area to allow cutting of the block into equal halves, as necessary in construction. The first and second side surface (90 and 92) has a tapered detent (94) which allows ease of cutting the construction block in half. The detent is particularly useful when a hand saw is used in cutting of the block, the detent operating as an alignment guide. The detent leads to a cut line (96) that encompasses the block, the cut line providing a guide but allows use of a knife by reducing the wall thickness for ease of cutting.

To illustrate stability, tests have been made to show that when the construction block is filled with sand, a wall constructed of the construction blocks can carry a truss load with or without a top plate. If no top plate is used, the structure will be able to support a plant load of over 3,000 pounds with the deflection of about a one half inch and a permanent deflection of approximately three quarters of an inch. The wall construction can support trusses on approximately 2 foot centers spanning approximately 85 feet. This assumes a live load of 20 PSF with a dead load of 15 PSF. With a load deflection curve, it is noted that sand placed in the construction blocks loading by a truss in the same manner but spanning only 40 feet would deflect approximately a one half inch.

If a double 2×8 wood plate is placed on top of the structure, the construction block can support up to 5,800 pounds with a temporary deflection of about 2 inches and a permanent deflection of about 1.1 inches. Roof trusses are spaced at 4 feet on center and loaded with 20 PSF live load and PSF dead load to span up to 80 feet. This same loading on a truss spanning 40 feet would result in a deflection of about 1.15 inches. The testing has discovered that the construction block is able to support point loads from wood trusses for reasonable truss spans, with or without a wood top plate. The top plate is useful in spreading out the load and minimizing the corresponding deflection on the block. A second test was made on a structural property of the ability of the block to hold common drywall screws. It has been found that a drywall screw installed into any area into the top of the block with resist a minimum pullout of about 50 pounds, regardless of where it is installed in the top of the block.

Figure 5:
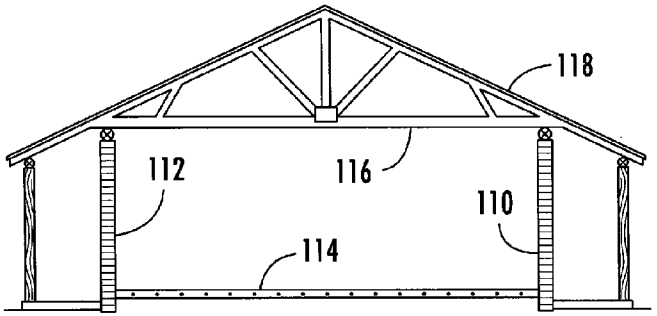
FIG. 5 is a cross sectional side view of a building section.
Figure 6:
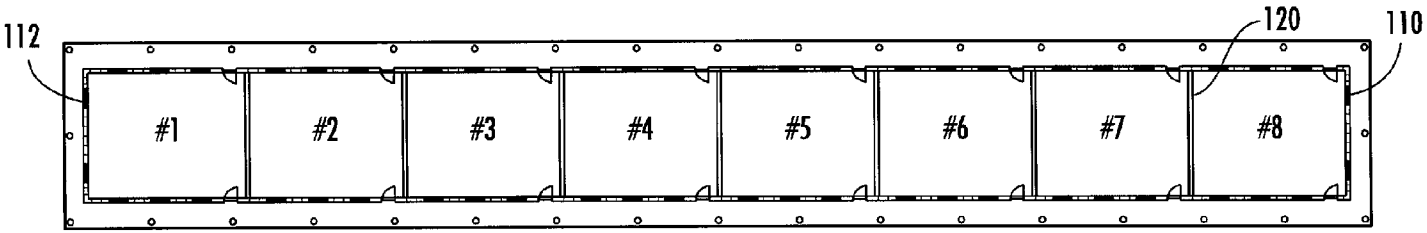
FIG. 6 is a top view of a building structure using the construction blocks of the instant invention.
Figure 7:
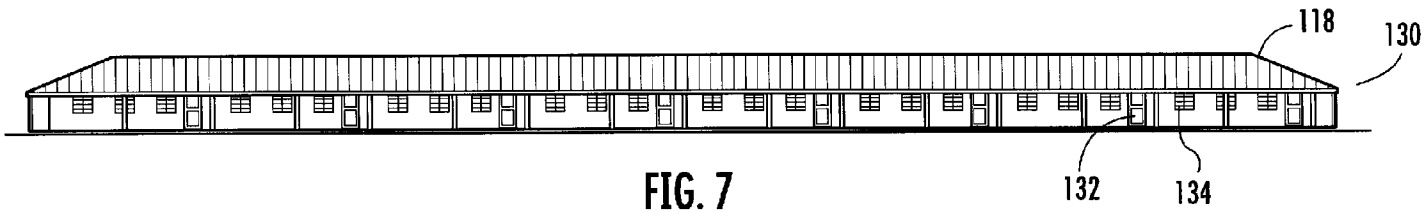
FIG. 7 is a front elevation view of the building structure of FIG. 6.

As shown in FIGS. 5-7, the construction blocks (110 and 112) are used in the construction of buildings to create a vertical wall in a similar manner to a cinderblock construction. Depending on the use, a floor (114) can be placed between the walls. It is noted that a foundation is not necessary for the walls. Shown is a cross sectional wall drawing having a wall with a height of 21 stacked blocks. Conventional wood trusses (116) are used for support of the roof (118). Further, as shown in FIG. 6, the construction blocks can be used to construct an entire structure with either divider walls made from the blocks or by use of drywall dividers (120). As previously noted, drywall can be hung from the construction blocks to provide a conventional-looking interior. It should also be noted that a filled construction block provides an R-9 rating factor for energy and sound deadening. FIG. 7 depicts the front elevation of a structure (130). Doors (132) and windows (134) can be placed into the structure in a similar manner as those screwed into wood frames. It should be noted that the structure is receptive to the use of conventional screws for attachment, obviously screws used for thin wall holding including molly bolts will provide enhanced securement.

Figure 8:
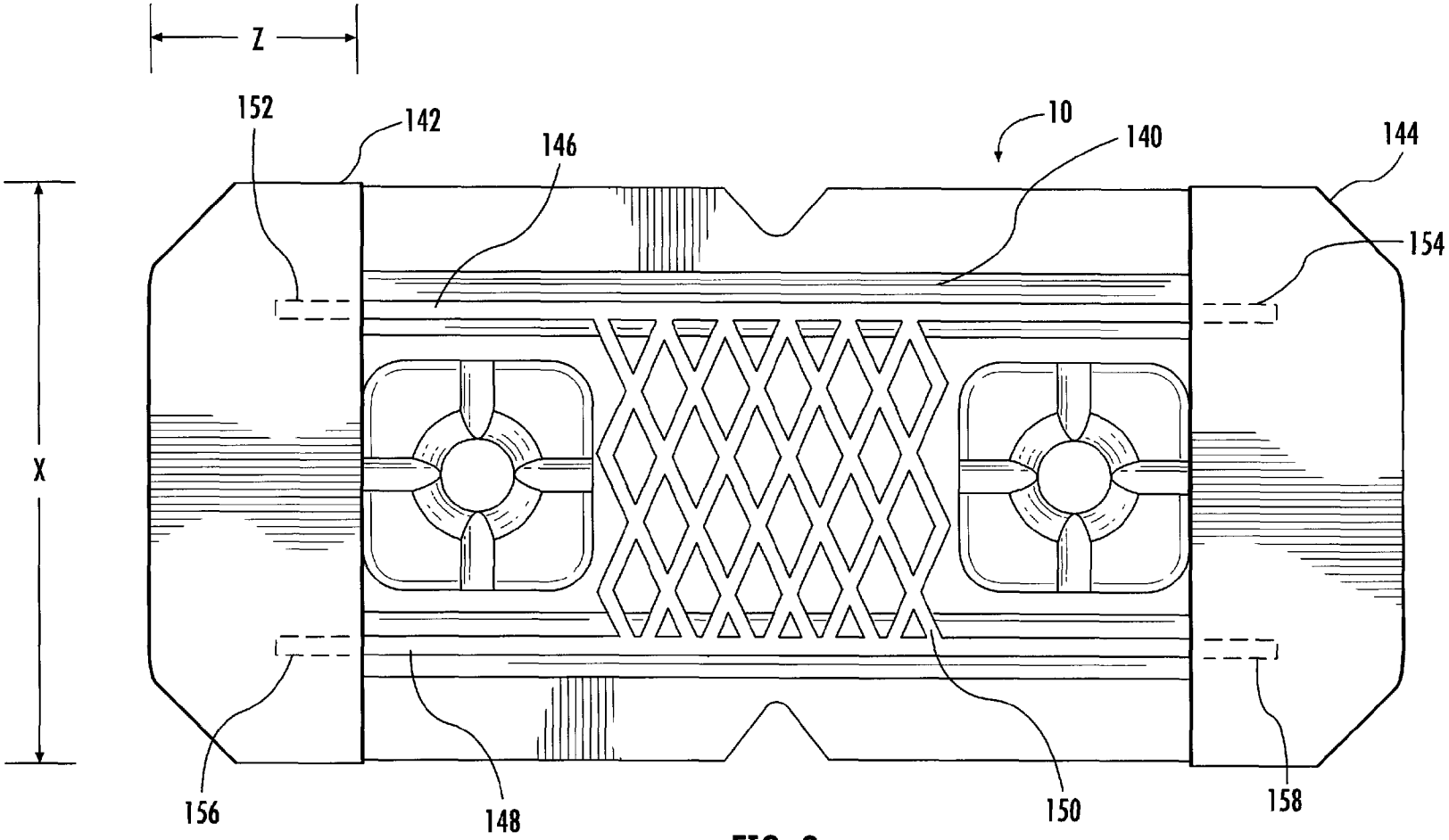
FIG. 8 is a top view of the construction block having a fire grate held in position by a first and second utility receptacle.
Figure 9:
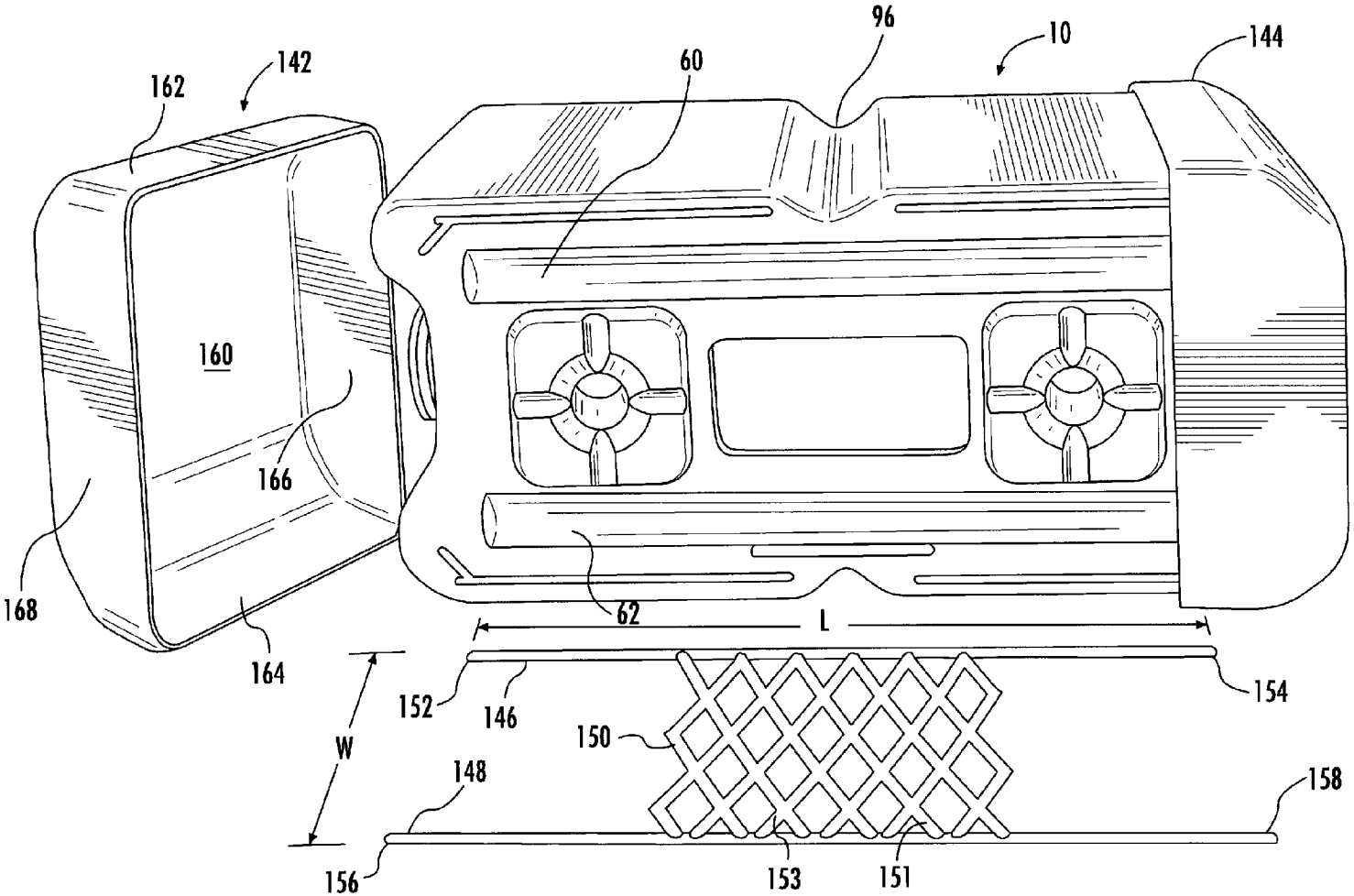
FIG. 9 is an exploded view of the construction block separated from a fire grate and a first utility receptacle.

Referring to FIGS. 8 and 9, illustrated is a top view of the construction block (10) having a fire grate (140) held in position by a first utility receptacle (142) and a second utility receptacle (144). The fire grate (140) is further defined by a first rod post (146) spaced apart from a second rod post (148) by a mesh (150). The mesh (150) is constructed from steel and is tack welded to the first and second rod posts (146 and 148).

The construction block has a first anchoring pipe retaining socket (60) and a second anchoring pipe retaining socket (62) allowing placement of the first and second rod posts (146 and 148) for shipping purposes. A proximal end (152) of the first rod post (146) extends beneath the utility receptacle (142) to maintain the fire grate (140) in position during storage. Similarly, the distal end (154) of the first rod post (146) extends beneath the utility receptacle (144); the proximal end (156) of the second rod post (148) extends beneath the utility receptacle (142); and the distal end (158) of the second rod post (148) extends beneath the utility receptacle (144).

The utility receptacles (142 and 144) are constructed and arranged to fit over each end of the construction block (10) and are interchangeable. The utility receptacles (142 and 144) are held in place by frictional engagement with the construction block (10), trapping the fire grate (140) beneath the utility receptacles (142 and 144) until removed.

It should be noted that besides the benefit of shipping, the utility receptacles (142 and 144) provide reinforcement to the ends of the construction block (10) for shipping as well as storing. For instance, during shipping the utility receptacles (142 and 144) protect the construction blocks (10) from damage due to load shifting during transport, as well as inadvertent damage caused by fork lift drivers. The utility receptacles (142 and 144) can be made of aluminum, steel, or in instances where the utility receptacles (142 and 144) are to be used in non-heat related uses, plastic.

The fire grate (140) has a mesh (150) that is tack welded to the rod posts (146 and 148). The tack welding allows the mesh (150) to be removed from the rod posts (146 and 148) wherein the rod posts (146 and 148) can then be used for anchoring purposes. The mesh (150) is a conventional fire grate material formed from diagonal strips of metal as depicted by numerals (151 and 153) that allow the fire to pass through. The mesh (150) can be tack welded to allow subsequent disassembly or can be stamped. The mesh (150) is attached to an upper edge of each rod post (146 and 148) allowing the fire grate (140) to lay flush against the construction block (10) during storage and transportation. When the fire grate (140) is no longer needed, the fire grate (140) can be dismantled and the rod posts (146 and 148) used for anchoring pipes. For example, when two adjoining construction blocks are pressed together, the rod post (146 and 148) can be used as anchoring pipes wherein a rod post (146 and 148) can placed through aperture (24) extending from the front surface (16) to the rear surface (18) for alignment to an adjoining construction block having a similar aperture, as illustrated in FIG. 4 wherein the stake (80) is substituted with the rod post (146 or 148). The illustration further illustrates the blocks in an offset arrangement for stacking in a conventional brick and mortar block construction technique.

The utility receptacles (142 and 144) may also be used as endcaps should the construction block (10) be cut in half. As previously mentioned, the construction block (10) is designed to be cut into two pieces which allows for corner turns which may be necessary when the offset arrangement for stacking is employed. The utility receptacles can then be used as an endcap to seal the half block. The construction block (10) can then be filled with sand or soil and placed into the offset arrangement, with the utility receptacle (142 or 144) abutting an adjacent construction block to prevent dislodgement of the endcap. In addition, utility receptacles (142 and 144) can be used to protect corners that may be subject to high traffic. For instance, a doorway may have each of the construction blocks lined with the utility receptacles wherein a frame can be attached to the utility receptacles. The utility receptacles can be moved along the end of the construction block (10) thereby attaching directly to the frame wherein only the space between adjoining utility receptacles need be sealed.

Figure 10:
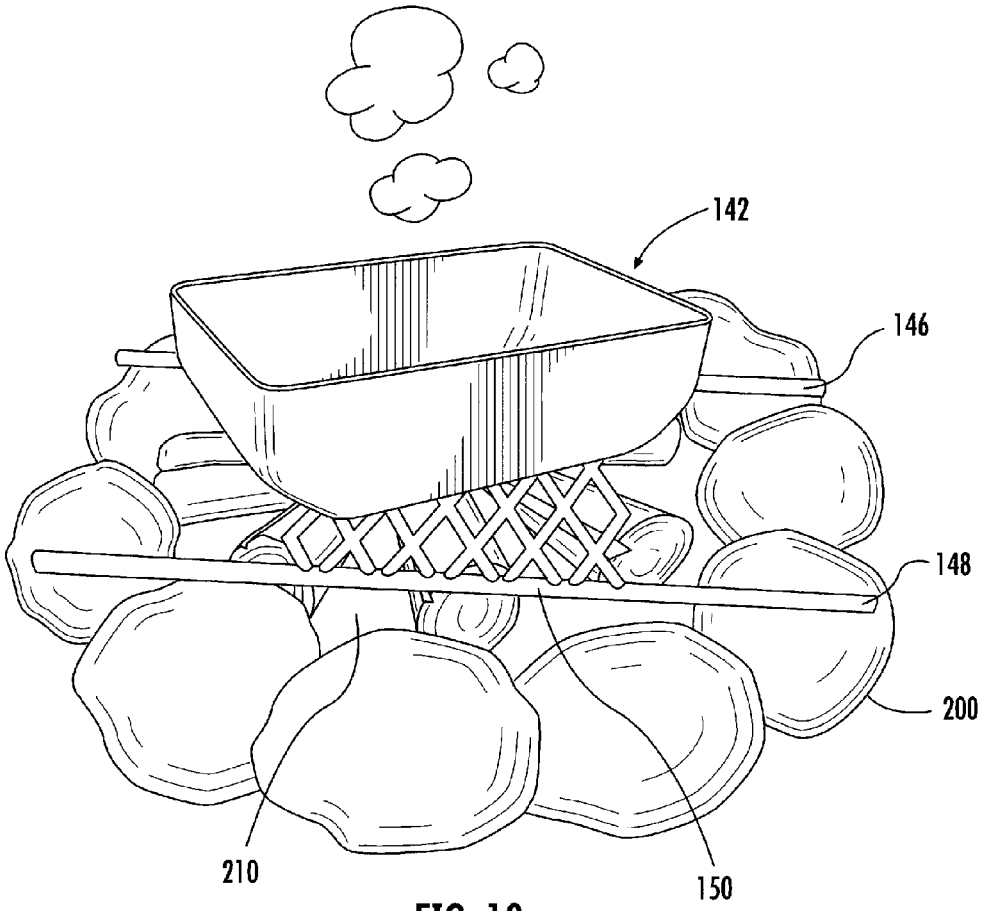
FIG. 10 is a pictorial view of the fire grate supporting a utility receptacle.
Figure 11:
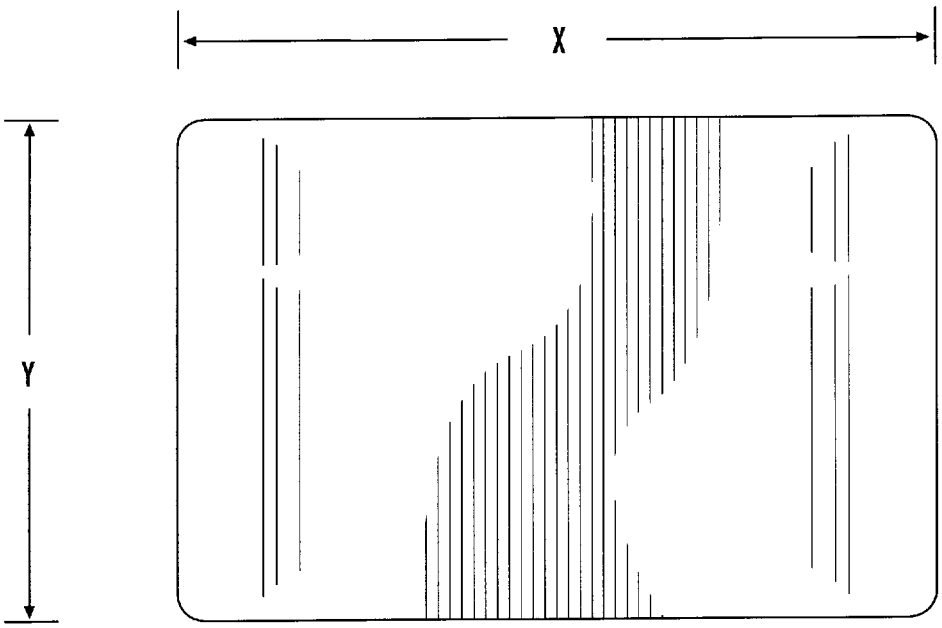
FIG. 11 is an end view of a utility receptacle.

Utility receptacle (142) is defined by a bottom wall (160) front and rear walls (162 and 164) and side walls (166 and 168); utility receptacle (144) is a mirror image. The shape permits multipurpose use as a drinking container large enough for livestock, a cooking pan, a scoop, or most any other use. Referring to FIG. 10, set forth is a pictorial view of the fire grate (150) placed on top of rocks (200) allowing a fire (210) to cook the food or heat/boil water within the utility receptacle (142). The utility kit can also operate as a mess kit wherein the kit includes eating utensils that are placed within a construction block used for transporting food (not shown). For instance, if dried rice is shipped a fork, knife, spoon and/or chopsticks can be placed in a plastic bag and shipped inside the container. In addition, it is contemplated that two plates are positioned within each utility receptacle, not shown, wherein the utility receptacles may be used for cooking and the flatware would allow four serving from the container to be served from the kit. The utility receptacles may also be used to create a steamer, with one utility receptacles can placed above one another wherein one receptacle can create steam for cooking contents in a second receptacle.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A utility kit comprising: a construction block formed from a plastic structure having a top surface, a bottom surface, a front surface, a rear surface, and opposing side surfaces forming a hollow interior, said top surface having a fill port opening allowing access to said hollow interior; a cap releasably secured to said fill port opening; said front surface having at least one raised; said rear surface having at least one receptacle, said raised protrusion on said front surface interlocking with a receptacle on a rear surface of an adjoining construction block for aligning similar shaped construction blocks;

at least one grate formed from a pair of anchoring pipes having a length and a diameter, said anchoring pipes spaced apart and attached to a mesh; and at least one utility receptacle defined by a substantially pan shaped housing constructed and arranged to fit over said top surface of said construction block and the end of said grate;

wherein said construction block is capable of storing fluids, food, and the like staples within said interior, and said grate and said utility receptacle on an outer surface, whereby said grate and said utility receptacle can be used for cooking the stored staples and said construction block can be reused to hold earth materials to allow for structure formation with said anchoring pipe of said grate available for placement through said apertures to interconnect said construction block with at least one adjacent construction block.

2. The utility kit according to claim 1 wherein said mesh is tack welded to said anchoring pipes.

3. The utility kit according to claim 1 wherein said utility receptacle is constructed and arranged to frictionally engage construction block.

4. The utility kit according to claim 1 wherein at least one side wall of said utility receptacle has a length sufficient to engage an end of said anchoring pipe to maintain said anchoring pipe against the construction block.

5. A utility kit comprising: a construction block formed from a plastic structure having a top surface, a bottom surface, a front surface, a rear surface, and opposing side surfaces forming a hollow interior, said top surface having a fill port opening allowing access to said hollow interior; a cap releasably secured to said fill port opening; a first aperture extending from said front surface to said rear surface; a second aperture extending from said front surface to said rear surface; said front surface having a raised protrusion placed about each said first and second aperture; said rear surface having a receptacle placed about each said first and said second aperture, said raised protrusion on said front surface interlocking with a receptacle on a rear surface of an adjoining construction block for aligning similar shaped construction blocks, each said aperture is further defined as a first frustoconical portion and a second frustoconical portion, both frustoconical portions having a wide opening and a narrow opening, said wide opening of said first frustoconical portion being disposed about said front surface, said wide opening of said second frustoconical portion being disposed about said rear surface, said frustoconical portions being joined together at the narrow openings by an annular tube; said front surface includes at least two anchoring pipe retaining sockets for temporary receipt of said anchoring pipes, said anchoring pipe retaining sockets being substantially parallel to each other and extending along said front surface; said rear surface includes at least two reciprocal anchoring pipe retaining sockets, each said reciprocal anchoring pipe retaining sockets having a depth of approximately one half the diameter of said anchoring pipe, said anchoring pipe retaining sockets on said rear surface being substantially parallel to each other, one of each said anchoring pipe retaining sockets on said rear surface extending along said rear surface, each of said reciprocal retaining sockets on said rear surface nesting with said anchoring pipe of an adjoining construction block for storage and shipping;

a grate formed from a pair of anchoring pipes having a length and a diameter, said anchoring pipes spaced apart and attached to a mesh; and at least one utility receptacle defined by a substantially pan shaped housing constructed and arranged to fit over said top surface of said construction block;

wherein said construction block is capable of storing fluids, food, and the like staples within said interior, and said grate and said utility receptacle on an outer surface, whereby said grate and said utility receptacle can be used for cooking the stored staples and said construction block can be reused to hold earth materials to allow for structure formation with said anchoring pipe of said grate available for placement through said apertures to interconnect said construction block with at least one adjacent construction block.

6. The utility kit according to claim 5 wherein said mesh is tack welded to said anchoring pipes.

7. The utility kit according to claim 5 wherein said utility receptacle is constructed and arranged to frictionally engage construction block.

8. The utility kit according to claim 5 wherein at least one side wall of said utility receptacle has a length sufficient to engage an end of said anchoring pipe to maintain said anchoring pipe in said anchoring pipe retaining socket.

* * * * *